United States Patent [19]

Nelson

[11] Patent Number: 4,697,317

[45] Date of Patent: Oct. 6, 1987

[54] PROCESS FOR THE PRODUCTION OF TWIST-FREE NOVELTY NUB YARNS

[75] Inventor: Thomas L. Nelson, Georgetown, Del.

[73] Assignee: E. I. Du Pont de Nemours and Company, Wilmington, Del.

[21] Appl. No.: 804,408

[22] Filed: Dec. 4, 1985

[51] Int. Cl.[4] ..... D02G 1/16; D02J 1/06

[52] U.S. Cl. ..... 28/258; 28/271; 57/209; 57/350

[58] Field of Search ..... 28/252, 258, 271; 57/209, 350

[56] References Cited

U.S. PATENT DOCUMENTS

| | | | |
|---|---|---|---|
| 1,997,771 | 4/1935 | McGowan . | |
| 2,278,879 | 4/1942 | Hunter . | |
| 2,878,548 | 3/1959 | Lohr et al. . | |
| 3,042,482 | 7/1962 | Woodell . | |
| 3,093,878 | 6/1963 | Fieldman . | |
| 3,433,007 | 3/1969 | Myers . | |
| 3,653,196 | 4/1972 | Pike | 57/350 X |
| 4,119,253 | 10/1978 | Benson | 28/252 X |
| 4,212,152 | 7/1980 | Roman | 28/271 X |
| 4,453,297 | 6/1984 | London, Jr. et al. | 28/258 X |

FOREIGN PATENT DOCUMENTS

| | | | |
|---|---|---|---|
| 45-14580 | 5/1970 | Japan | 28/271 |
| 48-25387 | 7/1973 | Japan | 28/258 |
| 51-60749 | 5/1976 | Japan | 28/271 |
| 51-75156 | 6/1976 | Japan | 28/271 |
| 60-17135 | 1/1985 | Japan | 28/271 |
| 60-17134 | 1/1985 | Japan | 28/271 |

*Primary Examiner*—Robert R. Mackey

[57] ABSTRACT

A substantially twist-free, crimped, continuous, multifilament yarn containing randomly-spaced, tightly entangled nubs and the process and apparatus used for making such yarns is disclosed. The nub yarn is made by feeding a substantially entanglement-free multifilament crimped continuous yarn through a forwarding jet, through an aspirating entanglement jet where nubs are formed and passing the yarn through a loop guide. The nubs of the yarn are less than one inch in length and the yarn is useful in textile and carpet end uses.

5 Claims, 4 Drawing Figures

PROCESS FOR THE PRODUCTION OF TWIST-FREE NOVELTY NUB YARNS

DESCRIPTION

Technical Field

This invention relates generally to novelty yarns, more particularly, substantially twist free, crimped, continuous, multifilament yarn containing randomly-spaced, tightly entangled nubs and the process and apparatus used for making such yarns.

BACKGROUND

The production of novelty yarns has long been a major objective in the textile and carpet industry. These yarns are commercially valuable as they provide unique and desirable aesthetics to their end use articles. One such novelty yarn, nub yarn, refers to a yarn containing small lumps, knots or specks which have been introduced into the main fiber. Nub yarns are sometimes referred to as slub yarns, however nubs are generally shorter and more compact and thus have a larger diameter to length ratio than do slubs.

The presence of large slubs is undesirable for certain end uses where the aesthetics are more dependent on a low variability in slub size as well as an absence of large slubs.

Carpet containing small nubs is generally made from staple and the nubs are not tightly adhered to the core fiber. This type of carpet can be used only in low traffic areas, since the nubs are held in place only by the friction restraint of the twist. In a high traffic area, these carpets would quickly lose their nubs and the corresponding desirable aesthetic appearance.

SUMMARY OF THE INVENTION

Apparatus and a process have been developed to add randomly-spaced nubs numbering between 1 and 200 per 10 meters of yarn which are consistently less than 1" in length, preferably less than ½" in length, to a crimped, continuous, twist-free, multifilament yarn, thereby producing a novelty nub yarn for use by itself or in combination with additional yarns of the same or different dyeabilities.

The apparatus of this invention comprises a forwarding jet for forwarding feed yarn along a path, an aspirating nub-forming entanglement jet, having a tube passage diverging from the inlet to the outlet, a housing having a chamber in communication with the inlet end of the jet tube, an opening in the housing in line with and in communication with the inlet end of the jet tube and a means to supply gas to the chamber, positioned in line with said path to receive the yarn from the forwarding jet concurrently with said path into the inlet end of the entanglement jet tube and separated from the forwarding jet by a small interval and a means for guiding the yarn positioned adjacent to the exit of the forwarding jet to receive the yarn countercurrently with said path out of the inlet end of the entanglement jet tube.

The new process comprises a controlled overfeeding of a substantially entanglement-free, multifilament, crimped, continuous yarn through a forwarding jet having a flow of air therethrough and then, as a loop, concurrently with said flow of air into and countercurrently with said flow of air out of the entrance of a separate entanglement jet. The forwarding jet feeds the yarn along with a stream of fluid, e.g., air, through a feed tube into an entanglement jet to form nubs. Passing the yarn through highly turbulent gas within the entanglement jet, entangles the yarn, forming nubs. The legs of the loop are maintained at a close spacing to each other by a loop guide, located near the forwarding jet exit, such guide together with controlled overfeed acting to prevent the formation of large slubs during the preferred formation of nubs.

The nub yarn so produced is characterized by a denier per filament of 5–20, a total denier of 500–5000, and is interlaced to increase yarn coherence and then used as a single yarn or combined in the interlace step with additional yarns, with or without nubs for textile or carpet end use.

DETAILED DESCRIPTION OF THE DRAWINGS

Figure 1:
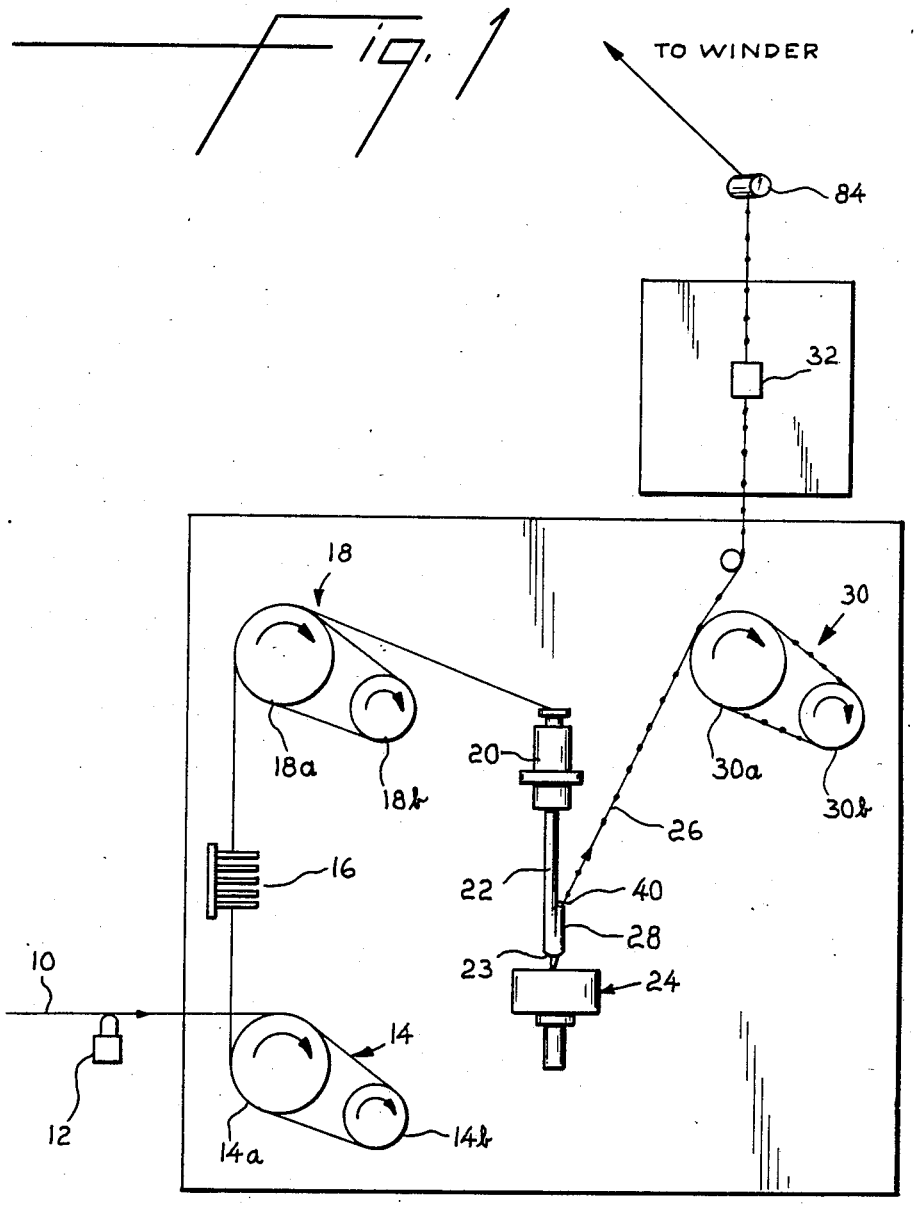
FIG. 1 shows one preferred embodiment of the process of this invention wherein a nub yarn is produced.

In FIG. 1 a crimped and interlaced supply yarn (10) is forwarded from a supply package over a yarn wetting device (12) by the first forwarding means (shown are rolls (14) where **(14*a*) is the driven roll and (14*b*) is an idler roll) and then through deinterlacing pins (16), such as those described in U.S. Pat. No. 4,059,873, to remove interlace from the crimped supply yarn. Tension through the pins is maintained by controlling the differential speeds of the first forwarding means (14) and the second forwarding means (shown are rolls (18) where (18*a*) is the driven roll and (18*b*)** is an idler roll).

The yarn is then forwarded by and through a third forwarding means, the forwarding jet (20), passing through the exit (23) of the forwarding jet and into the nub-forming entanglement jet (24). The nub yarn (26) then passes through a loop guide (28) as it is pulled from the entanglement jet (24) by a fourth forwarding means (shown are rolls (30) where **(30*a*) is the driven roll and (30*b*) is an idler roll). The nub yarn is then routed through an interlace jet (32)**, such as that described in U.S. Pat. No. 4,505,013, to add cohesion to the yarn, and then collected by a suitable means, such as a winder (not shown).

In the above process, the distance (34) (shown in FIG. 3) of the exit (23) of the forwarding jet from the entrance of the entanglement jet tube inlet (51) (shown in FIG. 3), air pressure and flow in both of these jets, and the wall thickness between the forwarding jet and the loop guide (40) are, in part, all important for efficient operation. It is also important that the overfeed of the yarn into the entanglement jet (24) be maintained at a level which allows for only the arch portion of the yarn loop to actually enter the body of the jet. This overfeed can vary depending on the speed of the yarn between about 5% and 40% and is controlled by maintaining a constant speed ratio between the forwarding means (18 and 30) located before and after the forwarding and entanglement jets. The yarn would generally be run at from about 100 yards per minute to about 1000 yards per minute or higher.

From the above described process, there can be produced a twist-free crimped continuous multifilament yarn of preferably 5–20 dpf containing randomly-spaced tightly cohered nubs consistently less than one inch, preferably less than about one-half inch in length and with interlace nodes randomly spaced between the nubs along the length of the fiber.

Figure 2:
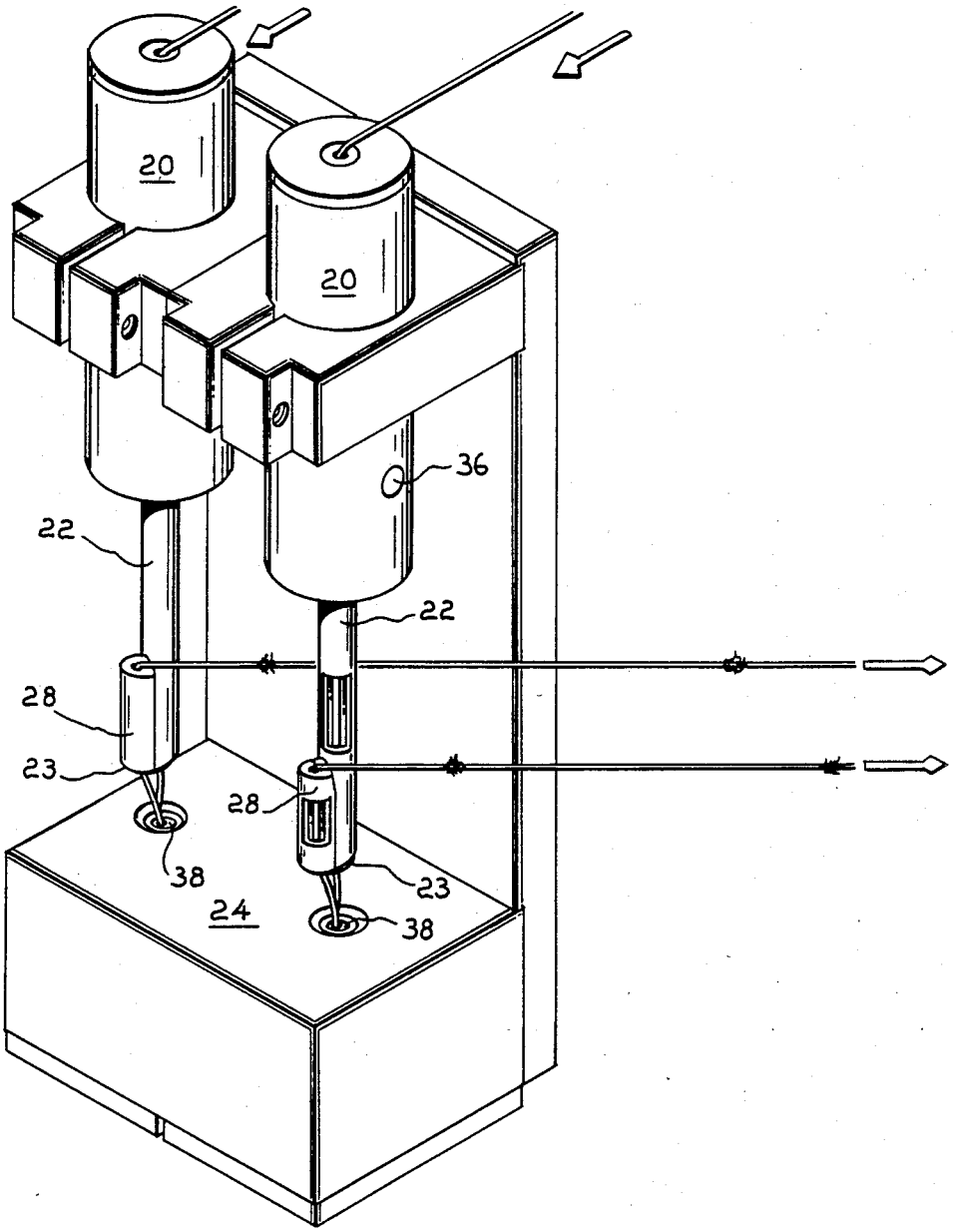
FIG. 2 shows a side-by-side arrangement of two forwarding and entanglement jet assemblies with a detailed view of the loop guides useful in practicing the invention.

FIG. 2 shows a detailed view of the apparatus essential in part for operating this process and a side-by-side arrangement of two jet assemblies for nub formation. Each complete assembly consists of three separate elements: the forwarding jet (20), a loop guide (28), and the nub-forming entanglement jet (24).

As shown in FIG. 2, the forwarding jet consists of a pneumatic feed jet (20) and an attached feed jet tube (22). The feed jet tube (22) is of a small bore diameter and can be connected to the feed jet (20) by any suitable means, e.g., a solder joint. The diameter of the feed jet tube exit is larger than the feed jet entrance diameter. The exit of the forwarding jet which is the feed jet tube exit (23), is radiused to eliminate yarn snagging. Forwarding air enters the feed jet through inlet (36) thereby providing yarn motive force. Air and yarn leave the feed jet through the feed jet tube exit (23) and enter the entanglement jet (24) through an opening (38) in the entanglement jet housing.

The forwarding jet serves several functions. It maintains tension on the threadline as it leaves the previous forwarding means (18 shown in FIG. 1) to insure constant yarn feed to the entanglement jet (24). The feed jet tube (22) establishes the location of the yarn at the entanglement jet entrance (38).

The loop guide (28) (shown in FIG. 2 as tubular-shaped) is typically attached to the lower end of the feed tube (22) section of the forwarding jet and parallel to the axis of the forwarding jet. The guide typically has a bore area about three times that of the feed tube to allow for smooth passage of the nub yarn. It is important that the separation (40) (shown in FIG. 3) between the feed tube bore and the loop guide be minimal and the common wall thickness should be less than 0.20 inches and is generally about 0.040". The main purpose of the loop guide is to insure that the legs of the overfed arched loop of yarn (the incoming leg from the feed jet tube and the outgoing leg exiting through the loop guide bore) are forced near each other during the process operation. This close configuration allows the unrestrained distal portion (or arch portion) of the loop to be more effectively acted upon by the turbulent flow conditions in the entanglement jet (24) and is conducive to the formation of the type of randomly-spaced nubs of the present invention. The legs should be as close together as is feasible and no more than about 0.5 inches apart.

Figure 3:
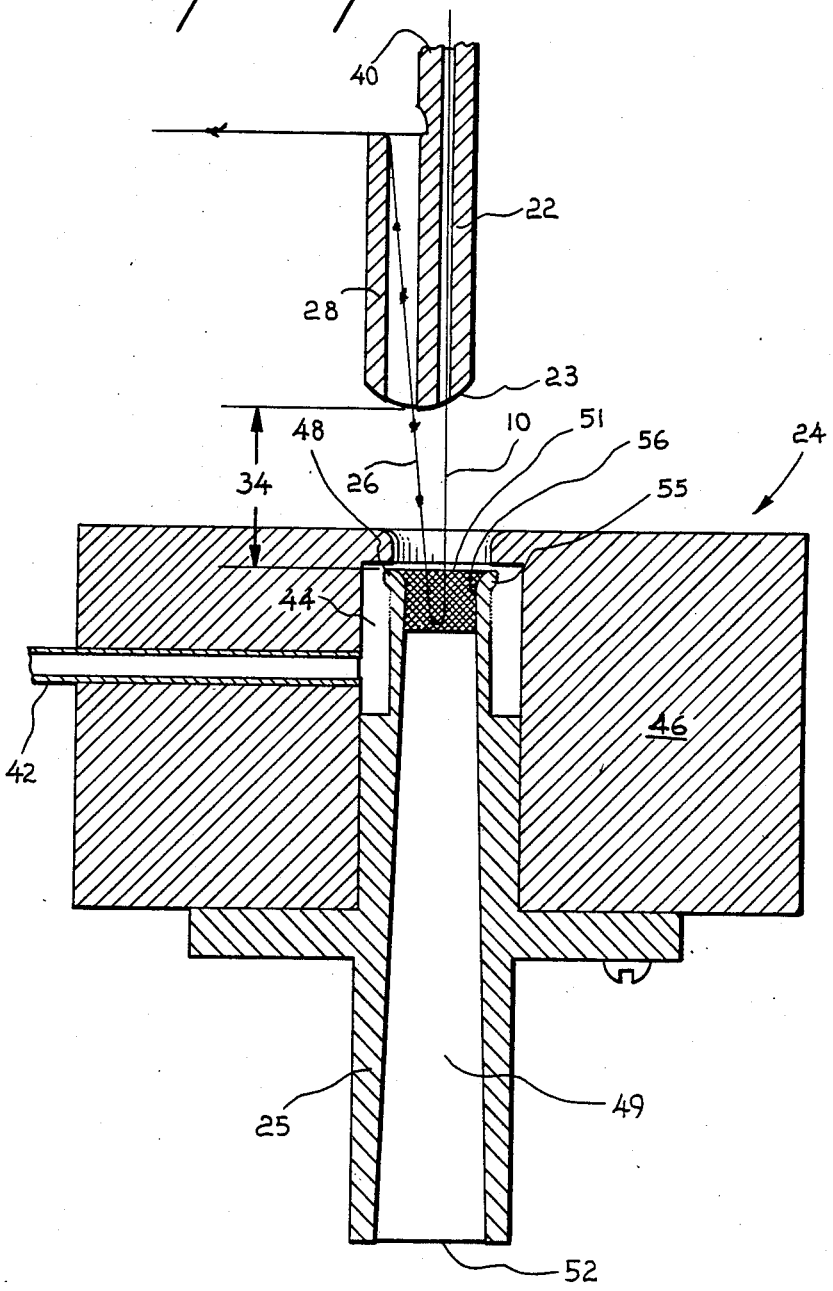
FIG. 3 is a detailed view of the nub entanglement jet, the feed jet tube and the loop guide.

FIG. 3 shows an aspirating, nub-forming entanglement jet (24) having a jet tube (25) having an inlet and outlet connected by a tube passage (49) diverging from the inlet to the outlet. Pressurized air is supplied through an inlet (42) to an annular air chamber (44) encased within a manifold housing (46). The high pressure manifold air increases in velocity as it exits via the very narrow opening (48) in the housing between the inlet end (51) of the entanglement jet tube (25) and the manifold housing and follows the surface of both the external lip (55) and internal curve surface (56) of the jet tube inlet area which are roughened (e.g., via grit blasting) to a surface finish greater than 20AA (according to The American Standard (B46-1-1955). The opening (48) between the jet tube inlet end and the manifold should be less than about 0.006 inches. The high velocity air acts to aspirate atmospheric air into the entanglement jet and out through the entanglement jet tube outlet (52).

The entanglement jet tube passage diameter (measured at the narrowest section of the passage) should be relatively narrow. In this process, tube passage diameters larger than 0.125" begin to produce a lower frequency of nubs along with the formation of larger slubs which also are not as well compacted. For example, carpet yarns with such oversized slubs can be unsatisfactory in a mill tufting operation and also can show poor wear performance. Entanglement jet tube passage diameters of less than 0.1" are substantially more efficient in the high frequency initiations and compacting of yarn nubs.

The opening (48) between the inlet end of the entanglement jet tube and the manifold housing should narrow to less than 0.006 inches to provide a high velocity flow rate through the opening.

The air exiting the feed jet tube affects turbulence in the nub-forming entanglement jet and therefore an optimal spacing (34) from the feed jet tube exit (23) to the entanglement jet tube inlet (51) must be established. This optimal spacing is partly determined by the air pressure supplied to the feed jet. For example, at a given pressure, if the feed jet tube exit is set too close to the entanglement jet entrance, there is a disruption of optimal flow conditions; and if the distance is too great, the desirable turbulence additive effect on the entanglement jet is decreased. The distance (34) from the forwarding jet exit to the entanglement jet entrance should be between about 0.2 and 0.6 inches.

Figure 4:
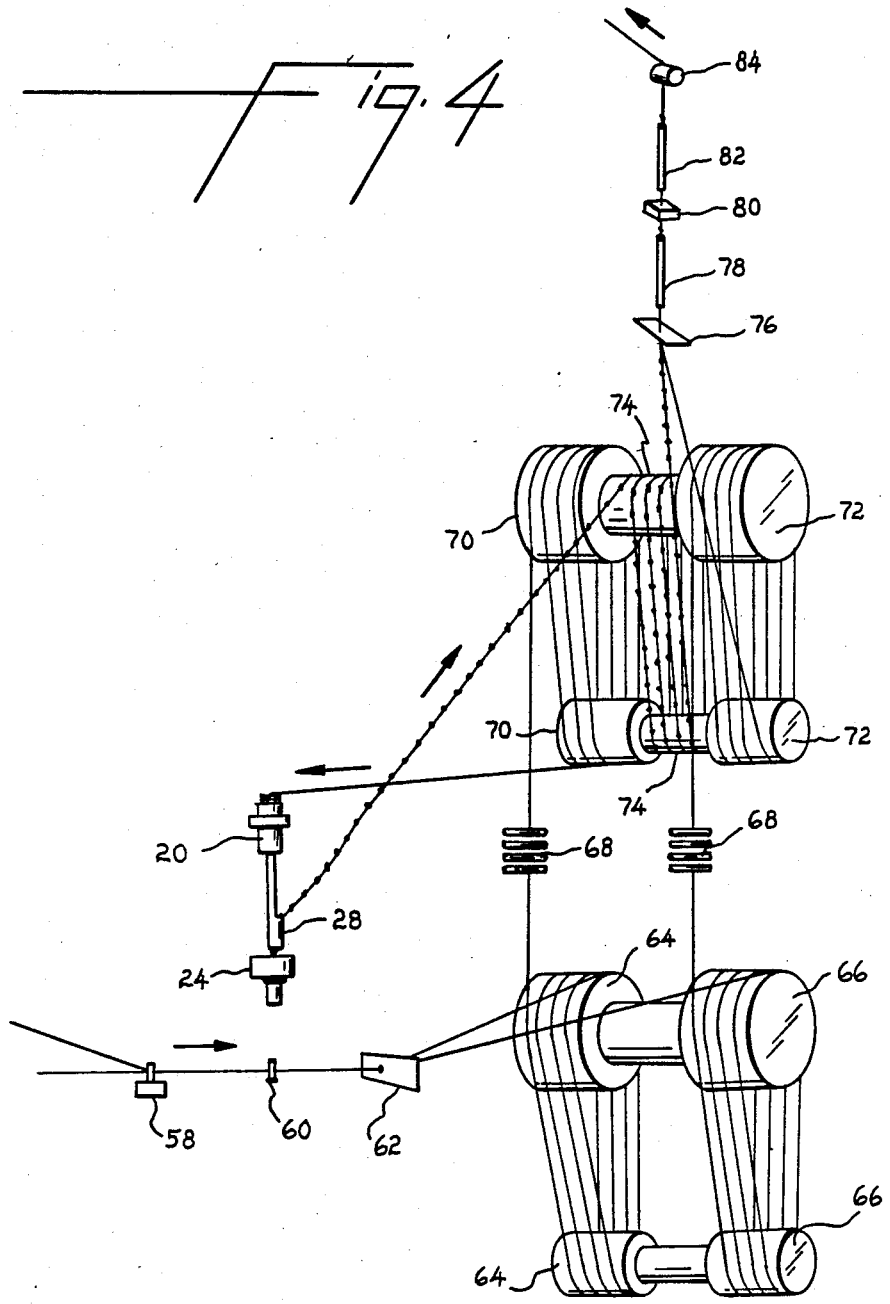
FIG. 4 shows an additional embodiment of the current proposal, whereby a nub yarn is combined with a yarn without nubs in a continuous process.

Although the current process can produce a single nub yarn for direct use. FIG. 4 shows one embodiment of the present proposal wherein two multifilament, crimped, interlaced, continuous single yarns are simultaneously fed into a system wherein one of the yarns (the effect yarn) forms nubs and then is cointerlaced with the second (noneffect) yarn to produce a single novelty yarn, e.g., a heather yarn. Similar processes have produced novelty yarns containing combinations of one to four non-nub yarns with one to two nub yarns. The dual jet assembly of FIG. 2 shows a detail for producing two nub yarns simultaneously. Any number of combinations could be produced while still using the basic principles of this concept. In addition to nub vs. non-nub yarn combinations, yarns of different dyeabilities (e.g., cationic vs. light acid vs. deep acid) can be combined to form unique heather-type products.

Further description of FIG. 4 shows two multifilament, crimped, continuous yarns separately fed into the process through a convergence guide (58), a water applicator (60), and a yarn guide (62), by way of a forwarding means (rolls 64 and 66). The yarn to be processed into a nub yarn is forwarded first by roll (64), through the deinterlacing pins (68) to remove interlace and then by a second forwarding means (70) to the feed jet (20). Tension at the deinterlacing pins is maintained by the speed ratio between rolls (700 and (64). The feed jet (20) maintains tension on the yarn and forwards it through the feed jet tube to the entanglement jet (24) wherein nubs are formed. The nub yarn is removed from the entanglement jet, passing through the loop guide (28) and forwarded by a suitable means (74). In FIG. 4, the ratio of diameters between rolls (70) and (74) determines the overfeed of the nub yarn component into the entanglement jet.

While the effect yarn is being processed, the second yarn in FIG. 4 diverges to a forwarding means (66), passes through deinterlace pins (68), and then to a second forward means (72). Tension at the deinterlacing pins is determined, as with the effect yarn, by the ratio of speeds between (72) and (66). The second yarn is then reunited with the nub yarn at the convergence guide (76) after which both yarns pass through a yarn guide tube (78), an interlacing jet (80), a second yarn guide tube (82) and then over an idler roll (84) and on to an appropriate takeup means such as a winder. In this case, a novelty yarn is produced from a combination of a nub and a non-nub yarn. The yarns could also have been of different dyeabilities to produce a unique heather-type product.

An example showing a preferred embodiment of the process elements and running parameters follows.

EXAMPLE 1

| | |
|---|---|
| Supply yarn | Crimped, continuous, multifilament yarn 1225 total denier/68 filaments |
| Yarn feed rate (FIG. 1 (18)) | 500 ypm |
| Deinterlace pin tension | 1.1 gpd |
| pin count | 5 |
| diameter | 0.25" |
| Water application | 1 gallon/hour |
| Feed jet | |
| fluid/temperature | Air/25° C. |
| PSIG/SFCM | 60/4.5 |
| Exit tube length/diameter | 3 × 0.060 (in.) |
| Loop guide Length/diameter | 1 × 0.110 (in.) |
| Forwarding jet/ loop guide; wall thickness | 0.040 (in.) |
| Distance between legs of yarn | approximately 0.040 to approximately 0.210 (in.) |
| Forwarding jet exit/ entanglement jet tube inlet; spacing | 7/16 (in.) |
| Nub-forming entanglement jet | |
| Tube passage (diameter) | 0.094 (in.) |
| Tube/manifold housing gap spacing | 0.0015 (in.) |
| Fluid/temperature | Air/25° C. |
| PSIG/SFCM | 150/4 |
| Tube inlet surface finish | 55 (AA) |
| Takeup roll rate (FIG. 1 (30)) | 393 ypm |
| Yarn overfeed to nub-forming entanglement jet | 27% |
| Interlace jet | |
| Fluid/temperature | Air/25° C. |
| PSIG/SCFM | 50/6 |
| Idler roll (FIG. 1 (84)) | 385 ypm |
| Overfeed to interlace jet | 2% |
| Winding tension | 175 g |
| Product | |
| 1240 total denier/ 68 filament | |
| Nub spacing (avg) | 100/10 meters |
| Nub length | <0.5 inches |

I claim:

1. A process for the production of a twist-free novelty nub yarn comprising the steps of:

(a) feeding a substantially entanglement free multifilament crimped continuous yarn through a forwarding jet having a flow of air therethrough;

(b) feeding the yarn as a loop concurrently with said flow of air into the entrance of an entanglement jet, having a jet tube aligned with the entrance of the entanglement jet, wherein substantially only the arch portion of the loop enters the entanglement jet tube;

(c) passing the yarn through highly turbulent gas within the entanglement jet, wherein the entanglement jet is substantially aligned with the forwarding jet to increase the turbulence in the entanglement jet by feeding the air out of the forwarding jet into the entanglement jet, wherein the distance from the forwarding jet exit to the entanglement jet tube inlet is greater than about 0.2 inches and less than about 0.6 inches;

(d) entangling the yarn, forming nubs; and (e) pulling the yarn countercurrently; with said flow of air out of the entanglement jet.

2. The process of claim 1 further comprising the additional step of guiding the yarn through a means for maintaining the distance between the yarn fed concurrently into the entanglement jet and the yarn pulled countercurrently out of the entanglement jet at less than 0.5 inches.

3. The process of claim 2 further comprising the steps of forwarding the multifilament crimped continuous yarn over a yarn wetting device and through deinterlacing pins before feeding the yarn through the forwarding jet.

4. The process of claim 3 comprising the additional step of passing the yarn through an interlace jet after it has passed through the guiding step.

5. The process of claim 4 wherein the yarn is overfed in an arched loop into the entanglement jet from the forwarding jet and the overfeed is maintained at a level which allows for the arch portion of the yarn loop to enter the tube passage of the entanglement jet tube.

* * * * *